United States Patent [19]

Donaldson, Jr.

[11] 4,042,990

[45] Aug. 23, 1977

[54] SINGLE POINT MOORING TERMINAL

[76] Inventor: Glenn B. Donaldson, Jr., 6952 Grovespring Drive, Rancho Palos Verdes, Calif. 90274

[21] Appl. No.: 726,631

[22] Filed: Sept. 27, 1976

Related U.S. Application Data

[63] Continuation-in-part of Ser. No. 633,972, Nov. 21, 1975, abandoned.

[51] Int. Cl.[2] ..... B63B 21/52; B63B 35/44

[52] U.S. Cl. ..... 9/8 P; 114/230

[58] Field of Search ..... 9/8 P; 114/230, 264; 61/86, 94, 97

[56] References Cited

U.S. PATENT DOCUMENTS

| | | | |
|---|---|---|---|
| 3,466,680 | 9/1969 | Schirtzinger | 9/8 P |
| 3,472,032 | 10/1969 | Howard | 61/46 |
| 3,765,463 | 10/1973 | Gassett et al. | 9/8 P |
| 3,778,854 | 12/1973 | Chow | 9/8 P |

*Primary Examiner*—Trygve M. Blix
*Assistant Examiner*—Jesus D. Sotelo
*Attorney, Agent, or Firm*—Max Geldin

[57] ABSTRACT

A single point mooring terminal or system which can be used for ship mooring and cargo transfer, which includes a spar type floating buoy combined with a tethered underwater buoy concentric to the spar buoy. The underwater buoy is in the form of a collar which is mounted around the spar buoy and is completely submerged and anchored to the seabed by collar mooring lines. The spar buoy is free to move vertically within the collar, but is restrained from lateral and rotary movements by the collar. Thus, the collar restrains lateral movement of the spar buoy while introducing a minimal tilting moment. A mooring swivel can be mounted on the collar of the underwater buoy, and to which the bow mooring line of a ship can be attached to permit the ship to swing freely around the buoy system. A leak-proof skirt is connected to the bottom of the spar buoy, and is in the form of an inverted bucket so that when a fluid having lower density than seawater, such as air, is introduced into it, seawater is forced out through the bottom and an air pocket is provided for containing motion compensators connecting the pipe risers from the seabed pipeline to piping within the buoy so that the pipe compensators are not immersed in seawater. The air filled skirt also allows personnel to enter it through an airlock from the spar buoy for inspection and maintenance purposes.

48 Claims, 4 Drawing Figures

51
45
44
16
55
43
47
50'
57
42
12
84
59
49
82
86
46
18
3
50
14
64
76
46
70
68
72
32
3
74
66
52
30
54
26
24
60
23
60
56
28
53
60
28
58
63
SEA WATER
82
62
91
78
48
40
77
40
80
20
78
80
88
22
34
90
36
38

SINGLE POINT MOORING TERMINAL

This application is a continuation-in-part of my copending application Ser. No. 633,972, filed Nov. 21, 1975, now abandoned.

BACKGROUND OF THE INVENTION

The present invention relates to an improved single point mooring terminal or system (SPM) for ships, and is particularly concerned with a mooring system of the above type which is highly stable and efficient, and incorporates a spar buoy which is movable freely in a vertical direction, but which is restrained from lateral movement and from rotary movement by inclusion of a second, submerged buoy which restrains the spar buoy in an ocean current with minimum tilting, such buoy system also including a submerged housing which can be filled with air or other light fluid to provide an environment free of seawater for containing and operating motion compensators for piping, valves and the like, and permitting entry of personnel into such environment for inspection and maintenance purposes.

The single point mooring terminal presently employed consists of an anchored buoy which is used simultaneously for ship mooring and cargo transfer. The ship moors with bow lines, and is therefore free to swing around the mooring with changing weather conditions. This feature eliminates a major disadvantage of the traditional dockside and multi-point moorings which prevent ships from swinging while moored, and therefore required cargo operations to be carried out only in protected waters or favorable weather.

The single point mooring terminal is particularly advantageous for the loading and unloading of hazardous fluids such as crude oil and petroleum products, reactive and/or toxic chemicals, and refrigerated flammable gases such as liquid natural gas. The single point mooring terminal thus avoids possible collisions and disasters from major fire or explosion, by permitting the loading and unloading of these hazardous chemicals and fluids in remote waters away from congested waters near harbor entrances and within ports. Thus, hazardous cargoes can be transferred in isolated, restricted anchorages by means of the single point mooring terminal.

One principal disadvantage of presently employed single point mooring systems involves instability of the mooring system. Conventional single point mooring systems generally have a mooring swivel located on the top of the buoy above the ocean surface. Forces exerted by movement of the ship are therefore transmitted through the top of the buoy, causing various buoy motions which can limit use of the single point mooring system to favorable weather conditions.

Further, with most SPM systems presently employed, fluid cargo is transferred between the buoy and one or more seabed pipelines by means of flexible hoses, for transport to dockside facilities. A second set of flexible hoses runs along the water surface between the buoy and the ship's loading or unloading station. To accomodate swinging of the ship, multiple fluid swivel joint is located on the buoy, between the horizontal and vertical hoses. A principal disadvantage of such designs results from the location of flexible hoses, shutoff valves, and in some designs, the location of the piping swivel joint beneath the buoy. Safe and economic operation of the SPM requires reliable performance of these components over long periods of time. However, they function in a hostile environment, at a location where inspection and servicing are unusually difficult.

With refrigerated cargoes, such as cryogenic fluids, ice formation can also occur, leading to accelerated failure of flexible hoses. These components must therefore be insulated, leading to reduced flexibility and reduced operating life. When a cryogenic hose failure occurs or is imminent, replacement must be accomplished under the buoy without wetting internal surfaces. This accordingly is a difficult and complex operation. Further, except for the shutoff valves, these components are subjected to continuous movement by wave action and movement of the buoy itself. The use of conventional mooring lines attached directly to a single buoy allows significant lateral movement at low tide, due to slack in the lines, and this movement causes wear on the fluid connections between the buoy and seabed. This results in a relatively short useful life of the components and in addition the components can be degraded by corrosion or fouling in the marine environment.

Failure of a fluid component on a single point mooring system can cause environmental pollution, safety hazards, and loss of valuable commodities. Such failures also can result from fatique failure due to excessive movement of the mooring system, or from excessive strains due to fatique failure of the mooring system itself.

Another form of conventional SPM terminal consists of an anchored spar buoy. The conventional spar buoy becomes less stable when located in shallow water such as near the shore. With tidal changes, buoyancy varies and since the system is generally restrained near the extreme bottom, it is subject to tilting in a tidal current.

Various prior art systems have been developed in an effort to avoid many of the above noted problems.

Thus, U.S. Pat. Nos. 3,407,416; 3,474,749; 3,635,253; 3,894,567 and Published Patent Application No. B-379,955 disclose spar buoys, or slender, vertical cylinders weighted at the bottom for stability. All of these devices are moored using multiple chains running from the spar buoy to anchors on the seabed. With such an arrangement, the chains must be slack at low tide so that the buoy can rise with the tide. This slack means that the buoy has the disadvantage that it can drift laterally at low tide. In all of these patents catenary moorings are employed, that is the anchor chains are extremely heavy and therefore droop in catenary curves. The spar buoy must be large enough to support the weight of these chains with its buoyancy.

The devices of U.S. Pat. No. 3,614,869, and the above noted U.S. Pat. Nos. 3,407,416; 3,894,567 and Published Patent Application No. B-379,955 would appear to tilt excessively in areas of strong ocean currents. This is due to the fact that the mooring chains are attached well below the buoy's center of drag, and/or the ship is attached to the buoy well above the attachment point for the anchor chains. In either case, a strong ocean current would cause excessive tilting of the buoy. These patents, and also U.S. Pat. No. 3,837,380 employ either flexible hoses, pipe with swivel joints, or pipe with ball socket joints immersed directly in seawater. They are therefore difficult to inspect or maintain, subject to corrosion at critical points, and would be non-feasible for transfering a low temperature cryogenic fluid such as liquid natural gas, due to icing of the otherwise movable parts. It is noted that U.S. Pat. No. 3,837,380 mentions the use of a natural gas liquefier on the moored ship to avoid this problem. However, natural gas is customarily liquefied at a shore facility and piped to the ship as cold liquid, and relocation of the liquefier on the ship itself is a costly and undesirable change.

U.S. Pat. No. 3,474,749 involves a spar buoy with a concentric, buoyant collar. However, in this case the collar is the surface platform, or primary buoy, while the vertical cylinder is used only to increase tension in the catenary mooring chains. The patent does not disclose fluid transfer conduits or ship mooring capability.

U.S. Pat. No. 3,407,406 describes a system with long, vertical cylinders which can be flooded to vary buoyancy of the system. However, this capability is employed only to change the spar buoy's orientation from horizontal to vertical during installation.

U.S. Pat. Nos. 3,155,069; 3,404,654 and 3,675,609 disclose systems for controlling relative motion between the surface platform and the moored ship, and do not relate to problems of buoy stability of fluid transfer between the seabed and the ocean surface. Although the latter two patents disclose a skirt open at the bottom, which entraps a fluid of lower density than seawater, the fluid so trapped is oil employed to lubricate a mechanism within the skirt.

U.S. Pat. No. 3,778,854 discloses a mooring and oil transfer system including an elongated vertically positioned spar buoy wherein the ship's mooring line is attached near the top of the spar buoy above the water line, and to which is also attached a large crane. This construction causes the buoy to tilt, and variable ballast is provided to offset such tilting. An anchoring collar is rigidly attached to the spar buoy as a means for connecting the anchoring chains. However, as the relative positions of the spar buoy and collar cannot be altered with changing tidal conditions, the system is restrained in an optimum manner only at certain times during each tide.

A particular object of the present invention is the development of a reliable single point mooring system to minimize movement due to tidal and wave effects. Another object is the provision of means in such stable single point mooring system which permits housing of motion compensators for piping in an air atmosphere rather than seawater to thereby permit transfer of low temperature cryogenic fluid such as liquid natural gas, without icing of the surrounding seawater, and which permits access to such zone by personnel for inspection, maintenance and repair operations. Still another object is the provision of means for mooring a ship to the buoy so that the ship's presence has a negligible affect on motion characteristics of the buoy system.

DESCRIPTION OF THE INVENTION

Buoy stability is achieved according to the invention by a unique combination of two buoy types in order to obtain the desirable motion characteristics of each in a single unit. These include a spar type floating buoy in combination with a tethered underwater or submerged buoy, the spar buoy being freely movable in the vertical direction, but is restrained from lateral and rotary movements by the second or submerged buoy.

The spar buoy is of tall, relatively slender design with only the upper portion or tip protruding above the water or ocean surface. Although such buoys can be extremely insensitive to wave action, they can drift laterally and tilt with conventional mooring procedures or with a ship moored to the upper tip. On the other hand, a shorter buoy can be extremely motionless if provided with excess buoyancy and anchored well below the ocean surface. Forces generated by wave action are smaller than at the surface, and are negligible in comparison to the tensile forces generated in the mooring lines by the excess buoyancy of such buoy.

Thus, according to an important feature of the invention, there is employed a fully submerged buoy in combination with the spar buoy, to restrain the lateral movements of the spar buoy. This is accomplished by passing the spar buoy within a vertical hole through the fully submerged buoy so that the spar buoy remains free to move vertically a controlled or predetermined amount with tidal action but is resistant to wave action and is restrained from rotary and lateral motion. The submerged buoy is tethered or anchored to the marine bottom or seabed, e.g. by mooring lines or alternatively, by means of rigid structural columns. As a further feature, the lateral restraint imposed by the submerged buoy is applied at about the height of the spar buoy's center of drag, which minimizes tilting due to an ocean current. The spar buoy's center of drag is defined as the point where a single, equivalent force would provide the same response in the buoy as is provided by the various distributed drag forces exerted by an ocean current. Another way of defining such center of drag is the pivot point where all of the clockwise moments and all of the counterclockwise moments exerted by the ocean currents on the spar buoy are approximately equal.

The above combination of spar buoy and fully submerged buoy affords a highly stable, limited motion buoy system.

In conventional single point mooring systems a ship mooring swivel is located on the buoy above the ocean surface. Thus, forces exerted by movement of the ship are transmitted through the top of the buoy, causing various buoy motions which can limit use of the single point mooring system to favorable weather conditions. According to another feature of the present invention, an underwater mooring swivel is mounted on the fully submerged buoy rather than the spar buoy and the mooring collar on the submerged buoy is located near the spar buoy's center of drag. This provides a highly stable system in which the mooring lines or mooring structures for the submerged buoy and the ship mooring line are both connected to the fully submerged buoy at points spaced a relatively short vertical distance from each other. The length of the ship's mooring line preferably is selected so that this line is in the same plane as the taut mooring lines for the fully submerged buoy on the opposite side thereof. Ship-induced forces are therefore transmitted directly to the buoy mooring lines without any affect of the behavior of either the submerged buoy or the spar buoy.

According to another feature of the invention, there is provided a skirt in the form of an inverted bucket connected to the bottom of the spar buoy, with the submerged buoy positioned around the spar buoy between the top portion of the spar buoy and the skirt mounted at the bottom of the spar buoy. When a fluid having lower density than seawater, such as air, is introduced into the skirt, such fluid rises to the top of the skirt enclosure and forces seawater out through the open bottom of the skirt until the entire skirt is filled with the lighter fluid.

Such skirt therefore provides a non-seawater environment underneath the spar buoy which is not entirely sealed off from the surrounding seawater. Rigid, vertical risers of conventional pipe can be erected from the seabed pipeline and passed through the open bottom of the skirt into the non-seawater environment or space therein. Motion compensators, e.g. in the form of lengths of rigid pipe containing one or more fluid swivel joints can be provided in the environment or space within the skirt, and connecting the pipe risers from the seabed pipeline to piping within the buoy, thereby compensating for vertical motion of the spar buoy. Thus, such motion compensators can operate in the optimum, e.g. air, environment rather than being immersed in seawater.

A number of additional advantages accrue from the above noted skirt concept of the invention. If the piping is used to transfer cryogenic or very low temperature fluids such as liquid natural gas (LNG), the skirt can be filled with a gas to avoid icing of the pipe motion compensators. Further, less expensive materials can be used in construction of the pipe motion compensators which would corrode in seawater. The skirt can be filled with air, allowing personnel to enter it through an air-lock from the top of the spar buoy for inspection and maintenance purposes without the use of diving equipment or submarines. Personnel and equipment also can be transferred between the floating spar buoy and a seabed habitat or chamber without the use of diving equipment or submarines, rendering not only the pipe motion compensators in the skirt, but also the seabed valves easily accessible. Moreover, if the single point mooring system of the invention is used to transfer a cargo having lower density than seawater, the skirt will trap any leakage from the motion compensators. This permits detection of the leakage and corrective action before any environmental pollution occurs.

It is accordingly seen that the invention provides an improved single point mooring system which is highly stable, and provides a means for mooring a ship to the buoy system so that the presence of the ship imparts a negligible effect on the motion characteristics of the buoy, and also provides a rigid, leak-proof chamber in the form of a skirt extending beneath the buoy and having the functions and advantages noted above.

Additional advantages of the invention include the use of neutrally buoyant ship mooring lines to reduce buoy size, since the buoy does not need to support the weight of heavy chains, full submergence of the mooring buoy or collar so that it will not rise and fall with the tide, thus eliminating the possibility of slack mooring lines at low tide, suitability for use in areas where there are strong ocean currents, capability of the system for transferring cold liquids, and the like.

The mooring system of the invention is of value whenever stability and precise positioning of a floating structure is desired. Typical examples include offshore platforms for the recovery of natural resources such as oil and gas, offshore weather stations and marker buoys. However, it is of particular value as a single point mooring for the offshore transfer of fluid cargoes, including low temperature or cryogenic fluids such as liquid natural gas, via piping between a ship and a seabed pipeline. Such systems allow the ship to swing freely about the mooring while cargo is being transferred, facilitating cargo operations under widely varying weather conditions.

DESCRIPTION OF PREFERRED EMBODIMENTS

The invention will be described in greater detail below taken in connection with the accompanying drawings wherein.

Figure 1:
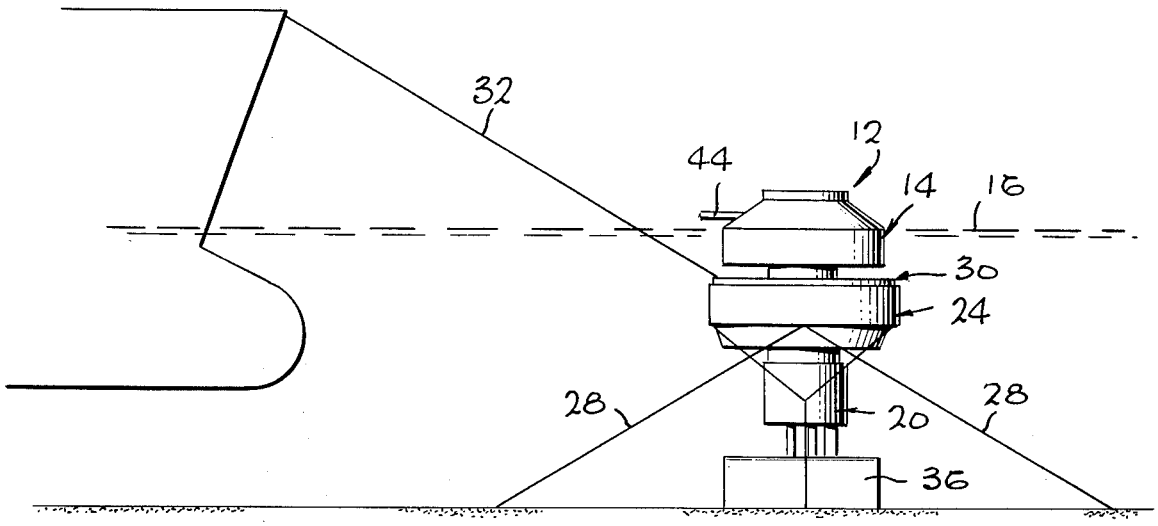
FIG. 1 is an elevational view of one preferred form of mooring system according to the invention.
Figure 2:
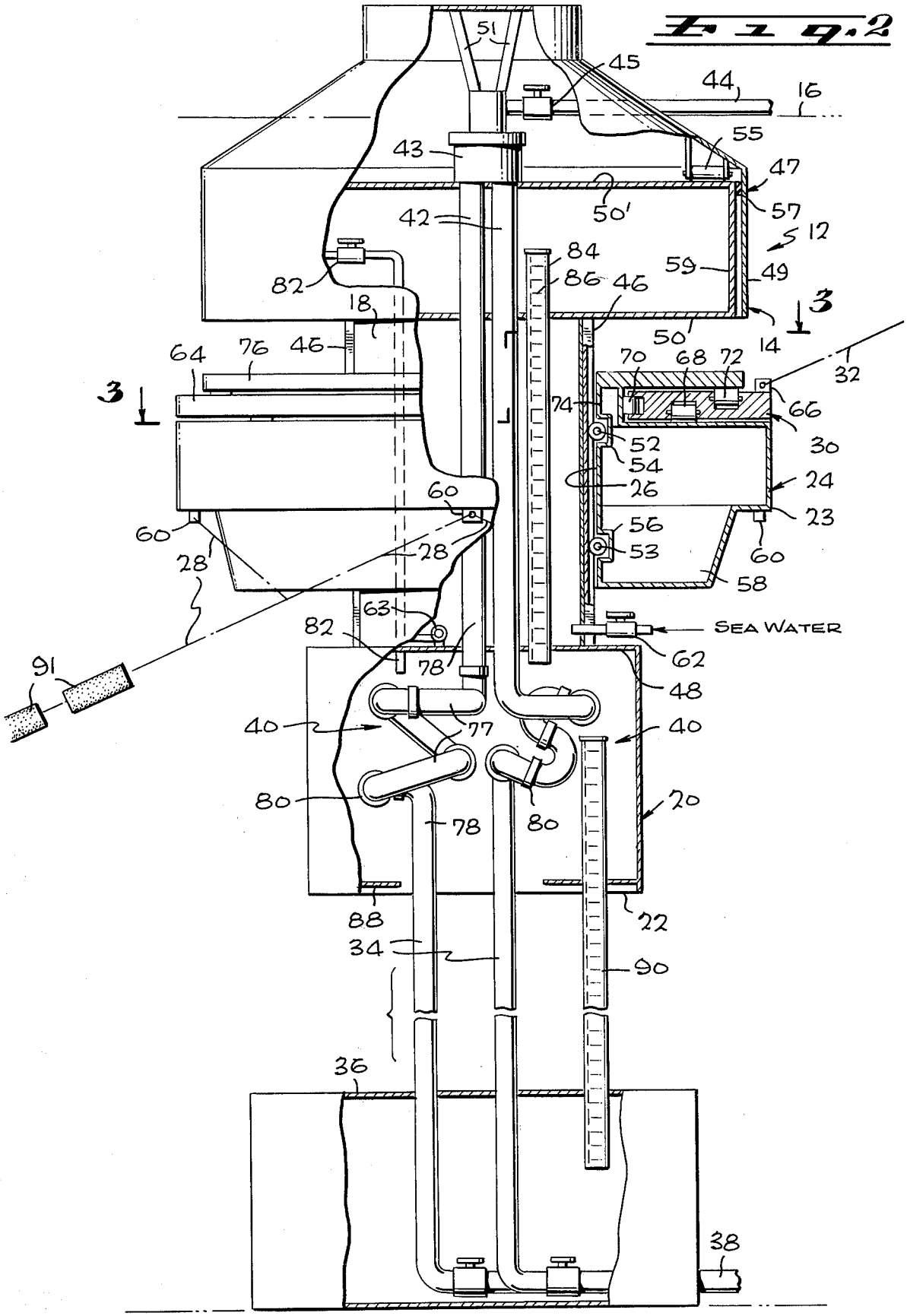
FIG. 2 is a detailed elevational view of the mooring system of FIG. 1. partly broken away for greater clarity.

Referring to the drawings, in FIGS. 1 and 2 illustrating a preferred embodiment of the single point mooring device or buoy of the invention, the device comprises a spar buoy 12 having an enlarged upper portion 14 which extends above the ocean surface 16 and an elongated tubular depending portion 18 of substantially smaller diameter than the diameter of the upper portion 14 to which it is connected. The interior of the upper cylindrical portion 14 can be sufficiently large to provide a working space for operating or maintenance personnel.

To the bottom of the depending submerged tubular portion 18 of the spar buoy 12 is connected a skirt 20 having its bottom 22 open to admission of seawater. Positioned on the tubular portion 18 of spar buoy 12, between the upper portion 14 and the skirt 20 is a submerged buoy 24 which encircles the tubular portion 18, and which has a central hole or aperture 26 of a diameter approximately equal to the diameter of the tubular portion 18 of the spar buoy, and is mounted to permit slideable vertical motion of the spar buoy 12 with respect to the submerged buoy 24, as described in greater detail below. The submerged buoy 24 is moored or anchored to the seabed by means of mooring lines 28. Attached to the upper end of the submerged buoy 24 is a mooring swivel 30 to which can be attached the bow mooring line 32 of a ship which is to be anchored at the single point mooring system of the invention for purposes of loading or unloading fluid cargo, e.g. crude oil or liquid natural gas.

Pipe risers 34 from a seabed valve chamber 36 and connected to a seabed pipeline 38, extend through the open bottom 22 of the skirt 20, into the lower end of the skirt, for connection with pipe motion compensators 40 positioned within skirt 20 and described in greater detail hereinafter.

The pipe motion compensator system 40 is connected to pipe risers 42 passing upwardly through the spar buoy 12 and connected via a single concentric swivel 43 of a type well known in the art, such as the Imodco swivel, and suitable valves 45 to floating or aerial transfer lines 44 which communicate with the ship's cargo holds. The aerial transfer lines 44 pass through a rotatable conical spray shield 47 mounted over the enlarged portion 14 of the spar buoy and having a depending cylindrical skirt 49 positioned around the outer periphery 59 of member 14, and diameter of the skirt 49 being slightly larger than the diameter of member 14. The rotatable spray shield 47 is supported by beams 51 from the top of the rotatable swivel 43, and rotates on rollers 55 connected at spaced intervals around the outer periphery of the inner surface of the conical spray shield, and contacting the top horizontal surface 50' of member 14. If desired, the rollers 55 can be omitted. A sealing ring 57 is provided in the space between the adjacent vertical surfaces of skirt 49 and the outer periphery 59 of member 14, to avoid introduction of seawater into the interior of the conical spray shield 47.

Figure 3:
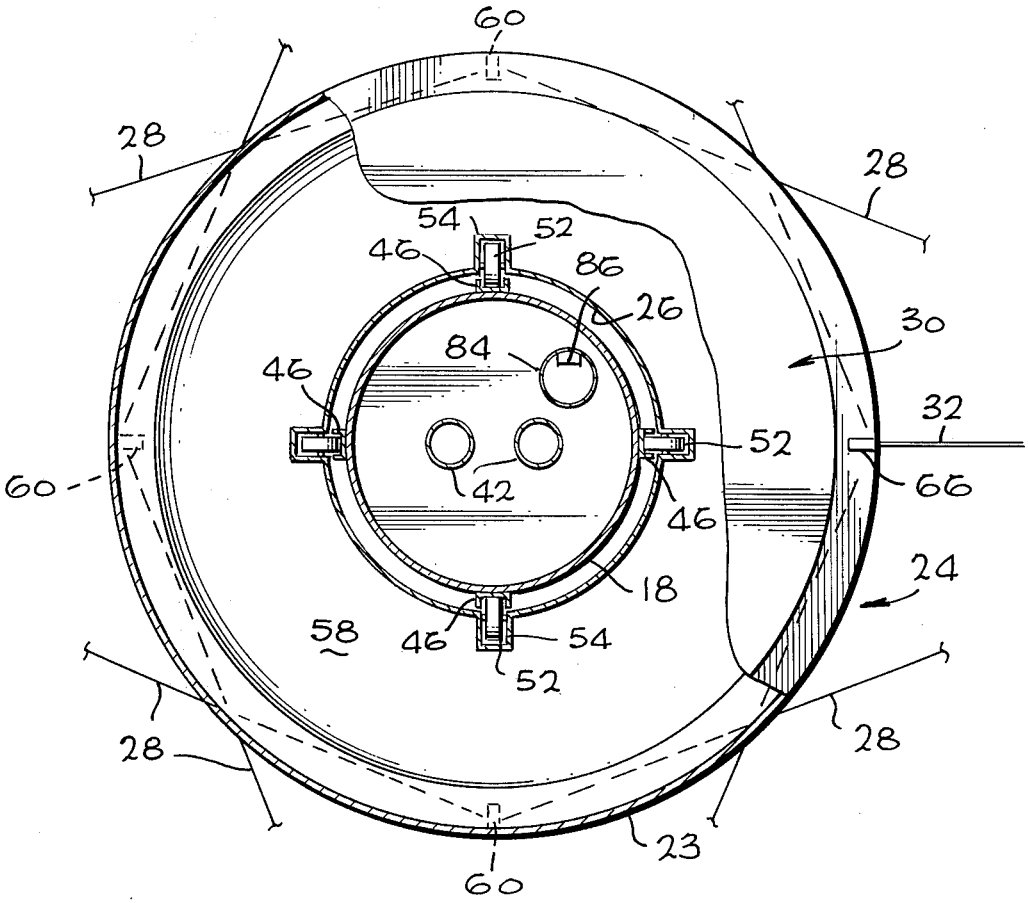
FIG. 3 is a horizontal section taken on line 3—3 of FIG. 2.

To permit vertical movement of the spar buoy 12 with respect to the submerged buoy 24, and referring particularly to FIGS. 2 and 3, the tubular portion 18 of the spar buoy is provided with a plurality, here shown as four in number, of guide rails 46, equally spaced at 90° intervals around the periphery of the tubular portion 18, such guide rails extending vertically or longitudinally, substantially from the upper closed end 48 (see FIG. 2) of the skirt 20 to the lower surface 50 of the upper portion 14 of the spar buoy. The rails 46 receive two sets of upper and lower rollers 52 and 53, respectively, mounted in recesses 54 and 56, respectively, of the collar 23 of the submerged buoy 24. Each set of the upper rollers 52 and the lower rollers 53 is comprised of four rollers mounted around the inner periphery of the collar 23, and equally spaced 90° from each other. The spar buoy 12 is free to move vertically within the anchored collar 23 of the submerged buoy 24, such movement being guided by the rails 46 and cooperating rollers 52 and 53, preventing rotary motion of the spar buoy 12. Buoyancy of the collar 23 of the submerged buoy 24 is provided by the large volume of air space 58 within the collar.

Four equally spaced diametrically opposed mooring eyes 60 attached to the outer periphery of the collar 23 are provided for connection of multiple mooring lines 28 to the seabed, to anchor the submerged buoy 24. The mooring eyes 60 are located on the collar 23 approximately midway between the upper and lower sets of rollers 52 and 53 on the collar. The diametrically opposed mooring eyes 60 are located below the center of buoyancy of the collar 23. This arrangement minimizes tilting of the collar 23 when the spar buoy 12 or water currents exert lateral forces on the collar.

In the absence of water currents, the spar buoy 12 is inherently stable. The submerged buoy 24 prevents random drift and the system is essentially motionless. Water currents exert a lateral drag force on the spar buoy, which is effective at the buoy's center of lateral resistance (BCLR). Lateral movement of the spar buoy is restrained by the collar 23, which is in turn restrained by the mooring lines 28. Thus, the center of lateral restraint of the collar 23 (CCLR) is at the height of the mooring eyes 60 on the collar and the restraining force is exerted at an oblique angle down the mooring lines.

Since the spar buoy 12 is free to move vertically, the center of lateral resistance of such buoy can move up and down with the tide. The collar's center of lateral restraint however can move upwardly only by stretching the taut mooring lines 28, and downward only if an additional force offsets the collar's buoyancy. When BCLR is above CCLR, a clockwise moment tends to tilt the spar buoy in one direction and when BCLR is below CCLR an opposite moment tends to tilt the spar buoy in an opposite direction. In each case however the degree of tilting is small and is proportional to the vertical separation between BCLR and CCLR. Thus, a very strong water current will tilt the buoy slightly. For a particular application, the system is designed to minimize tilting and lateral displacement at some point along the spar buoy. This can be accomplished by proper selection of the initial height of CCLR for the specific tidal conditions.

The submerged buoy 24 preferably is located at a height corresponding to the center of drag of the spar buoy 12, thereby affording restraint of the first buoy when the system is installed in areas of water currents, without tilting the spar buoy through the action of drag forces exerted by the currents on the spar buoy.

Any undesirable movements of the buoy system can be further reduced by use of a variable ballasting system on the spar buoy to minimize separation of BCLR and CCLR as the tide rises or falls, and for adjusting the draft of the spar buoy. For this purpose, there can be provided a valve 62 which can be suitably actuated to permit entry of a selected volume of seawater into the interior of the tubular portion 18 of the spar buoy between the skirt 20 and the upper portion 14 thereof, to decrease the buoyancy of the spar buoy, and a pump 63 to remove such water to increase the buoyancy of the spar buoy. However, if desired, a variable ballasting system including a separate ballast tank (not shown) can be incorporated into the tubular portion 18 of the spar buoy to provide a desired degree of ballast for the spar buoy.

Thus, the collar 23 restrains lateral movement of the spar buoy 12, introducing minimal tilting moment. Such tilting can be further reduced by the use of a simple variable ballast system as noted above, to minimize vertical movement of the spar buoy.

The ship mooring swivel 30 is in the form of a large ring or washer-shaped structure 64 located in a horizontal position adjacent the top of the mooring collar 23 of the submerged buoy 24. The ship's mooring line 32 is attached to an eye 66 on the mooring swivel near the periphery thereof. The mooring swivel is supported on sets of rollers 68, 70 and 72, allowing it to rotate freely with respect to the mooring collar 23. The lower rollers 68 are designed primarily to transmit the weight of the mooring swivel 30 to the collar 23 when no ship is present. The vertical rollers 70 react with a vertical, cylindrical surface 74 of the mooring collar, centering the mooring swivel as it rotates. When a ship is present these rollers transmit the horizontal component of the mooring load to the collar 23. The upper rollers 72 react with the bottom surface of an upper flange 76 integrally connected to the mooring collar 23. These rollers transmit the vertical component of the ship's mooring force through the flange 76 to the mooring collar. A buoyed or buoyant line can be attached at one end to the mooring swivel and free at the other end to be picked up by an approaching ship and attached to the bow of such ship, the ship thereafter being free to weathervane around the stable buoy system while moored.

The location of the mooring swivel 30 on the fully submerged buoy 24 rather than at the top of spar buoy 12, and thus providing an underwater mooring swivel is another feature of the invention. Thus, it is noted that the eyes 60 for the collar mooring lines 28 and the submerged eyes 66 for the ship mooring line 32, are relatively closely spaced vertically. The length of the ship's mooring line 32 is selected so that this line is in the same plane as, and is in alignment with, the taut mooring lines 28 on the opposite side of the fully submerged buoy, as seen in FIG. 1 of the drawing. Ship-induced forces are therefore transmitted directly to the buoy mooring lines without any effect on the behavior of either the submerged buoy or the spar buoy.

As previously noted, the vertical pipe risers 34 which pass into the lower end of the skirt 20 and the pipe risers 42 extending from the top of the skirt vertically upward through the spar buoy are connected together by motion compensator piping indicated at 40. The motion compensators 40 are required in order to compensate for vertical motion of the spar buoy and adjust for variation in vertical height of the pipe risers 34 and 42 as result of such motion. The motion compensator system 40 consists of lengths of curved pipes or elbows, and straight short pipe lengths, indicated at 77 and 78, respectively, connected together by swivel joints 80. Alternatively, such motion compensators can be comprised of sections of flexible hose connecting the vertical risers 34 and 42, or of sections of rigid pipe joined together with ball-socket joints, and the like.

However, motion compensators of the type shown and comprised of pipe sections 77 and 78, connected together by the swivel joints 80 are subject to wear and/or fatigue failure, and in the presence of seawater, to build-up of marine organisms inhibiting normal motion and to failure due to other environmental factors such as corrosion. In addition, motion compensators handling refrigerated fluids such as liquid natural gas are subject to icing, which can lead to failures by inhibiting normal freedom of the compensators. When replacement of such compensators becomes necessary, this must be accomplished without wetting the inner fluid surfaces during the change. Otherwise, ice would form within the pipeline after startup, and could cause failure of valves or other components elsewhere in the pipeline. This entails the necessity to include block valves adjacent to the motion compensators to facilitate isolation of a failed unit.

Further, both the compensators and the protective valving must be inspected, maintained and occasionally repaired or replaced. With current systems, this requires the use of submersibles, divers and/or other undersea equipment. These operations are both costly and time-consuming in undersea location.

Hence, according to another feature of the invention the frequency of maintenance and inspection operations of the above type, particularly for the compensators 40, is achieved by removing these most failure-prone devices of the system from direct immersion in seawater. This can be accomplished by introducing air or other gas or fluid under suitable pressure, through a compressed airline 82, into the interior of the skirt 20, forcing the seawater therein out through the open bottom of the skirt, and forming an air bubble or other favorable environment throughout the entire interior of skirt 20. In this manner the water level within the skirt 20 is below all of the compensator components, allowing "shirt-sleeve" access of maintenance personnel through an airlock tube 84 by ladder 86, or elevator, to a work platform 88 at the lower end of the skirt 20. Replacement components can also be lowered into the skirt 20 through the airlock tube 84. It is noted that such compressed gas is preferably a gas having condensation and freezing temperatures lower than those of cargo fluids within the pipe risers and the motion compensators 40, thereby permitting transfer of such cargo fluids without condensation or ice formation on the motion compensators.

In addition, another airlock tube 90 is provided for access of personnel from the air bubble within the skirt 20 to the seabed valve chamber 36 in the form of a leak-tight air-filled housing for maintenance and inspection of the valve systems therein, such seabed valve chamber also being provided in any suitable manner with an air environment or habitat. Airlock tube 90 is mounted to compensate for vertical motion of the spar buoy.

Figure 4:
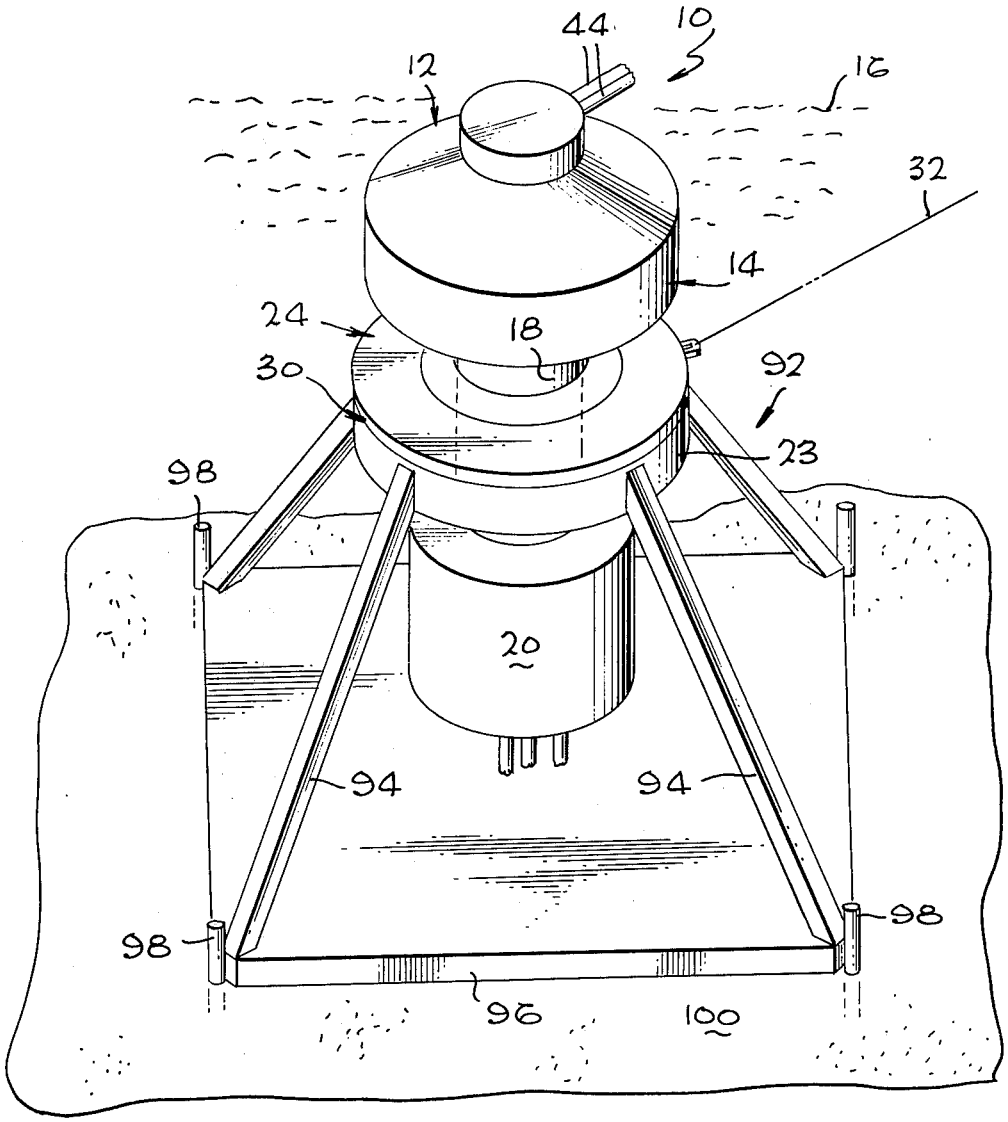
FIG. 4 is a perspective view of a mooring system according to the invention, having a modified form of anchoring device.

The buoy system described above and illustrated in FIG. 2 of the drawing preferably employs means for neutralizing the buoyancy of the mooring lines and thereby preventing slack or catenary arcs in the mooring lines. This can be accomplished by using buoyancy neutralizing materials such as commercially available plastics in fabricating such mooring lines, or if desired, by attaching buoyant floats, as indicated at 91, e.g. in the form of plastic foam or air-filled tanks, along the mooring lines 28 to offset the weight of heavier mooring line materials. However, alternatively, and as shown in FIG. 4 of the drawing, the mooring lines 28 for anchoring the submerged buoy 24 can be replaced by a fixed structural arrangement 92 comprised of a plurality of structural members 94 attached to the collar 23 of submerged buoy 24 at uniform intervals around the lower edge of the collar and extending downward and radially outward to individual pilings 98 supporting a weighted or ballasted base 96 on the marine bottom 100.

It will be noted that the upper water-free portion 14 of the spar buoy can be constructed of light weight materials and is made substantially larger in diameter than the lower tubular portion 18, and has a large volume in order to provide buoyancy, while the lower tubular portion 18 can be constructed of heavy materials and is provided with ballast by introduction of seawater, creating a righting moment which tends to prevent tilting, to maintain the spar buoy in an upright vertical position. Although air-filled skirt 20 also provides additional buoyancy, such buoyancy can be further offset by the provision of suitable additional ballast added to the tubular portion 18 of the spar buoy, in order to maintain the system balanced, as seen in FIG. 2, with the upper end of the skirt 20 and the lower end of the upper portion 14 of the spar buoy both spaced from the submerged buoy 24, in the static floating condition of the system. In this respect, however, it is desirable to maintain the size and volume of the skirt as small as possible yet sufficient to accomodate the motion compensator system 40, so as to provide minimum buoyancy at the lower end of the spar buoy, by the volume of air filling the skirt.

However, the upper end of the spar buoy need not be enlarged, and the spar buoy can be in the form of a straight cylinder, with the skirt 20 of the same diameter as the cylinder.

The single point mooring device of the invention has application for positioning floating structures or platforms for the offshore recovery of natural resources such as oil, gas and minerals. It has particular application however to the offshore loading and offloading of ships from a seabed pipeline. It is particularly applicable and designed for the loading and offloading of refrigerated or cryogenic fluids, such as liquefied natural gas.

From the foregoing, it is seen that the single point mooring system of the invention provides a highly stable system for marine applications and has a number of additional important advantages detailed above, particularly for application as a ship mooring for loading and unloading fluid cargoes such as liquid natural gas.

While I have described particular embodiments of my invention for purposes of illustration, it will be understood that various changes and modifications can be made therein within the spirit of the invention, and the invention accordingly is not to be taken as limited except by the scope of the appended claims.

What is claimed is:

1. A single point mooring system which comprises a first floating buoy having a downwardly depending elongated portion submerged in the water, a second submerged buoy positioned around said elongated portion of said first buoy, means anchoring said second buoy to the marine bottom, and means permitting vertical motion of said first buoy but restraining rotary motion thereof, said anchored second buoy also restraining said first buoy from lateral motion.

2. A single point mooring system as defined in claim 1, including a ship mooring swivel, means mounting said ship mooring swivel on said second submerged buoy and means on said swivel for fastening thereto a ship mooring line.

3. A single point mooring system as defined in claim 2, said anchoring means for said second buoy and said means for fastening a ship mooring line to said swivel, being connected to said second buoy a relatively short vertical distance from each other.

4. A single point mooring system as defined in claim 2, said anchoring means including a buoy mooring line, means connecting said buoy mooring line at one end to said second buoy and at the other end to said marine bottom, said means connecting said ship mooring line to said swivel being at a location above said connection of said buoy mooring line to said second buoy.

5. A single point mooring system as defined in claim 4, including a ship mooring line, the length of said ship mooring line being chosen so that said line is substantially in the same plane as the taut mooring line for said second submerged buoy on the opposite side thereof.

6. A single point mooring system as defined in claim 4, including means in said second buoy to maintain the buoyancy thereof against said buoy mooring line, and to maintain said mooring line taut.

7. A single point mooring system as defined in claim 1, including an inverted chamber connected to the lower end of said elongated submerged portion of said first buoy, said chamber being open at the bottom, and means for introducing a compressed fluid lighter than water into said chamber and forcing water therefrom.

8. A single point mooring system as defined in claim 7, said fluid being compressed air and forming an air atmosphere in said chamber, and including first pipe risers from a seabed pipeline, and second pipe risers passing through said elongated portion of said first buoy, and pipe motion compensators located in said chamber and connected to said first and second pipe risers.

9. A single point mooring system as defined in claim 4, including an inverted chamber connected to the lower end of said elongated submerged portion of said first buoy, said chamber being open at the bottom, means for introducing a compressed fluid lighter than air into said chamber and forcing water therefrom, first pipe risers from a seabed pipeline, and second pipe risers passing through said elongated portion of said first buoy, and pipe motion compensators located in said chamber and connected to said first and second pipe risers.

10. A single point mooring system as defined in claim 9, said pipe motion compensators comprised of short lengths of piping, and swivel joints connecting said short lengths of piping to permit relative motion between said first and second pipe risers in response to motion of said first buoy.

11. A single point mooring system as defined in claim 1, including means for varying the buoyancy of said first buoy.

12. A single point mooring system as defined in claim 2, including means for varying the buoyancy of said first buoy, said last mentioned means including valve means for introducing a predetermined amount of water into said elongated portion of said first buoy and pump means for removing said water.

13. A single point mooring system as defined in claim 2, said means permitting vertical motion of said first buoy but restraining rotary motion thereof comprising track means vertically disposed on the periphery of said elongated portion of said first buoy and cooperating roller means mounted on the inner periphery of said submerged buoy, and said ship mooring swivel being mounted at the upper end of said submerged buoy, and including roller bearing means for mounting said swivel on said second buoy.

14. A single point mooring system as defined in claim 8, including means for passage of personnel through said elongated portion of said first buoy and into said chamber, and including a seabed valve chamber, and passage means for personnel from said first mentioned chamber to said seabed chamber.

15. A single point mooring system which comprises a floating spar buoy comprising an upper enlarged portion and a depending elongated tubular portion of substantially smaller diameter than said upper enlarged portion, a second submerged buoy positioned around said elongated tubular portion of said spar buoy, said second buoy including a buoyant mooring collar and a ship mooring swivel mounted on the upper end of said collar, means anchoring said collar and said second buoy to the marine bottom, a skirt connected to the lower end of said tubular portion of said spar buoy, said skirt being open to the water at the bottom thereof, means for forcing water out of the bottom of said skirt and providing an air atmosphere in said skirt, means associated with said tubular portion of said spar buoy and with said collar of said submerged buoy permitting vertical motion of said spar buoy with respect to said anchored collar, and restraining said spar buoy from rotary and lateral motion, a seabed pipeline, first pipe risers from said seabed pipeline communicating with the lower interior portion of said skirt, second pipe risers passing through said tubular portion of said spar buoy and communicating with the upper interior portion of said skirt, and pipe motion compensators in said skirt and connecting said first and second pipe risers.

16. A single point mooring system as defined in claim 15, said anchoring means including a buoy mooring line, means connecting said buoy mooring line at one end to said collar and the other end to said marine bottom, means for connecting a ship mooring line to said swivel at a location above said connection of said buoy mooring line to said mooring collar, said points of connection of said mooring line to said mooring collar and of a ship mooring line to said swivel being spaced a relatively short distance from each other.

17. A single point mooring system as defined in claim 16, said means permitting vertical motion of said spar buoy but restraining rotary motion thereof comprising track means vertically disposed on the periphery of one of (a) said elongated tubular portion of said spar buoy and (b) the inner periphery of said mooring collar, and cooperating roller means mounted on the other of said peripheries, and including means comprising roller bearing for mounting the ship mooring swivel on said mooring collar.

18. A single point mooring system as defined in claim 16, including means in said mooring collar to maintain the buoyancy thereof against said buoy mooring line and to maintain said mooring line taut.

19. A single point mooring system as defined in claim 18, including valve means for introducing water into said elongated tubular portion of said spar buoy to decrease the buoyancy thereof, and pump means for removing water from said spar buoy to increase the buoyancy thereof.

20. A single point mooring system as defined in claim 16, including an air-lock tube passing through the tubular portion of said spar buoy and communicating with the upper end thereof and with the interior of said skirt, for passage of personnel into said skirt, a seabed valve chamber for said seabed pipeline, and an air-lock tube communicating with the interior of said skirt and with said seabed valve chamber for passage of personnel between the interior of said skirt and said seabed valve chamber.

21. A stable buoy system which comprises a first floating buoy having a downwardly depending elongated portion submerged into the water, a second submerged buoy positioned around said elongated portion of said first buoy, means for minimizing movement of said second buoy, means for minimizing tilting movement of said first buoy, means for adjusting the draft of said first buoy, and means permitting vertical movement of said first buoy but preventing rotary movement thereof.

22. A stable buoy system as defined in claim 21, said means for minimizing movement of said second buoy comprising means providing excess buoyancy within said second buoy and means for restraining said second buoy from rising.

23. A stable buoy system as defined in claim 22, said means for restraining said second buoy consisting of a series of mooring lines attached to said second buoy at uniform intervals around its lower edge, each extending downward and radially outward to individual pilings or anchors on the marine bottom.

24. A stable buoy system as defined in claim 23, including means for neutralizing buoyancy of said mooring lines and thereby preventing slack or catenary arcs in said mooring lines.

25. A stable buoy system as defined in claim 22, said means for restraining said second buoy consisting of a series of rigid structural members attached to said second buoy at uniform intervals around the lower edge thereof, each member extending downward and radially outward to individual pilings on the marine bottom.

26. A stable buoy system as defined in claim 21, said means for minimizing tilting movement of said first buoy comprising a water-free upper section constructed of light weight materials, and an elongated lower section constructed of heavy materials, containing variable ballast means, said sections thus creating a righting moment which tends to prevent tilting of said first buoy.

27. A stable buoy system as defined in claim 21, including valve means for introducing water into the lower section of said first buoy to decrease the buoyancy thereof, and pump means for removing water from said first buoy to increase the buoyancy thereof.

28. A stable buoy system as defined in claim 21, said means permitting vertical movement but restraining rotary means thereof comprising track means vertically disposed at regular intervals around the periphery of said elongated portion of said first buoy, and cooperating roller means mounted on the inner periphery of said second buoy to engage said tracks.

29. A stable buoy system as defined in claim 22, including a rotatable ship mooring fixture mounted on said second buoy slightly above the attachment points for said means for restraining said second buoy, with roller means for supporting and restraining said rotatable mooring fixture, including a buoyed or buoyant line attached at one end to said mooring fixture and free at the other end to be picked up by an approaching ship and attached to the bow of said ship, said ship thereafter being free to weathervane around the stable buoy system while moored.

30. A ship mooring system as defined in claim 29, the length of said buoyed or buoyant line being chosen so that when taut, said line is substantially in alignment with said means for restraining said second buoy on the opposite side thereof, thus assuring that forces exerted on said mooring line by said ship are transmitted directly through said second buoy into an opposite restraining member of said means for restraining said second buoy without effect on said first buoy.

31. A ship mooring system as defined in claim 29, including conduit means for transferring fluid or fluidized commodities between a moored ship and the top of said first buoy as said ship weathervanes around said mooring system, without transmitting forces between said mooring system and said ship through said conduit means.

32. A ship mooring system as defined in claim 31, including an inverted chamber connected to the lower end of said first buoy, said chamber being leak-tight around the sides and top but open to water at the bottom, and including first pipe risers from said seabed pipeline, and second pipe risers passing through said elongated portion of said first buoy and connecting with said conduit means, and pipe motion compensators located in said chamber and connected to said first and second pipe risers.

33. A single point ship mooring terminal as defined in claim 32, said pipe motion compensators comprised of short lengths of piping, and swivel joints connecting said short lengths of piping to permit relative motion between said first and second pipe risers in response to motion of said first buoy.

34. A single point mooring terminal as defined in claim 32, including means for introducing a fluid lighter than water into said chamber and displacing water therefrom, thereby isolating said motion compensators from the water environment.

35. A single point mooring terminal as defined in claim 34, said fluid being compressed gas and forming a gaseous atmosphere in said chamber, thereby locating said motion compensators in a gaseous environment.

36. A single point mooring terminal as defined in claim 35, said fluid being compressed air and forming an air environment in said chamber, and including means for passage of personnel through said elongated portion of said first buoy and into said chamber without escape of the compressed air environment therefrom.

37. A single point mooring terminal as defined in claim 36, including a leak-tight, air-filled housing located on said marine bottom beneath said first buoy, and including passage means for personnel betweeen said chamber and said housing.

38. A stable buoy system as defined in claim 21, said second buoy being located at a height corresponding to the center of drag of said first buoy, thereby affording restraint of said first buoy when said system is installed in areas of water currents, without tilting said first buoy through the action of drag forces exerted by said currents on said first buoy.

39. A single point morring terminal as defined in claim 34, said fluid being a compressed gas having condensation and freezing temperatures lower than those of cargo fluids within said first and second pipe risers and said motion compensators, thereby permitting transfer of said cargo fluids without condensate or ice formation on said motion compensators.

40. A single point mooring system as defined in claim 24, said means for neutralizing buoyancy of said mooring lines comprising buoyant floats attached along said lines to offset the weight of heavier mooring line materials.

41. A single point mooring system as defined in claim 15, including a rotatable spray shield mounted on said upper enlarged portion of said spar buoy.

42. A single point mooring system as defined in claim 41, said enlarged upper portion of said spar buoy being cylindrical, said spray shield being conical and having a depending point around said enlarged upper portion of said spar buoy, and including a seal between said last mentioned depending portion and the periphery of said enlarged upper portion of said spar buoy.

43. A single point mooring system as defined in claim 15, including a second swivel mounted on said upper enlarged portion of said spar buoy, said second pipe risers connected to said second swivel, a spray shield mounted over said second swivel and said upper enlarged portion of said spar buoy, and means connecting said spray shield to said second swivel for rotation of said spray shield on said second swivel.

44. A single point mooring system as defined in claim 43, said enlarged upper portion of said spar buoy being cylindrical, said spray shield being conical and having a depending skirt portion around said enlarged upper portion of said spar buoy, and including a sealing ring between said last mentioned depending portion and the periphery of said enlarged upper portion of said spar buoy.

45. A single point mooring system as defined in claim 44, including fluid transfer lines connected to said second swivel and in communication with said second pipe risers, said transfer lines passing through said rotatable spray shield and rotatable on said second swivel with said spray shield.

46. A single point mooring system as defined in claim 45, including rollers mounted on the inner periphery of said spray shield and contacting an upper surface of said enlarged upper portion of said spar buoy.

47. A ship mooring system as defined in claim 32, including a swivel mounted on said first buoy, said second pipe risers connected to said swivel, said conduit means also connected to said swivel and permitting rotation of said conduit means.

48. A ship mooring system as defined in claim 47, including a rotatable spray shield mounted over said first buoy, said conduit means passing through said rotatable spray shield.

* * * * *